US006874774B2

(12) United States Patent
Todié

(10) Patent No.: US 6,874,774 B2
(45) Date of Patent: Apr. 5, 2005

(54) METHOD FOR PRODUCING IMAGES IN THE EDGE OF A VOLUME OF PAPER SHEETS

(76) Inventor: Cristian Todié , 3 rue du Pot de Fer, F-75005 Paris (FR)

( * ) Notice: Subject to any disclaimer, the term of this patent is extended or adjusted under 35 U.S.C. 154(b) by 0 days.

(21) Appl. No.: 10/204,379

(22) PCT Filed: Jan. 17, 2001

(86) PCT No.: PCT/FR01/00141

§ 371 (c)(1),
(2), (4) Date: Nov. 4, 2002

(87) PCT Pub. No.: WO01/60630

PCT Pub. Date: Aug. 23, 2001

(65) Prior Publication Data

US 2003/0107164 A1 Jun. 12, 2003

(30) Foreign Application Priority Data

Feb. 17, 2000 (FR) ..... 00 01941

(51) Int. Cl.[7] ..... B41F 13/58; B41M 3/00
(52) U.S. Cl. ..... 270/5.02; 101/483
(58) Field of Search ..... 101/483, 476; 270/5.02, 1.01

(56) References Cited

U.S. PATENT DOCUMENTS

| | | | | | |
|---|---|---|---|---|---|
| 1,932,153 | A | * | 10/1933 | Bergendahl | 281/15.1 |
| 2,597,396 | A | * | 5/1952 | Squires | 156/233 |
| 3,817,492 | A | * | 6/1974 | Raymer | 283/63.1 |
| 4,854,202 | A | * | 8/1989 | McNab et al. | 83/153 |
| 4,951,569 | A | * | 8/1990 | McNab et al. | 101/483 |
| 4,969,665 | A | * | 11/1990 | Thiaville | 283/114 |

FOREIGN PATENT DOCUMENTS

| | | |
|---|---|---|
| FR | 2 542 259 A | 9/1984 |
| FR | 2 651 179 A | 3/1991 |

* cited by examiner

*Primary Examiner*—Andrew H. Hirshfeld
*Assistant Examiner*—Leo T. Hinze
(74) *Attorney, Agent, or Firm*—Oppedahl & Larson LLP

(57) ABSTRACT

The present invention concerns a method for producing an image in the edge of a volume of paper sheets. The invention can be used for numerous stationary products, note pads, exercise books, and the like. In the present invention, the images are printed not on the edges but on the paper surface. The method comprises a series of steps: printing-realigning-guillotining. The invention also concerns the insertion of a segmented image, systematically in edges and added in the make-up of a volume, for use in a complex technological process.

22 Claims, 4 Drawing Sheets

Example of device and procedure leading to final binding

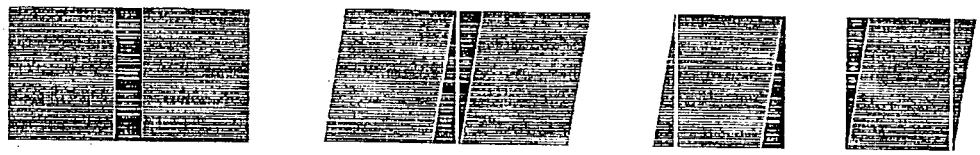
fig. 14
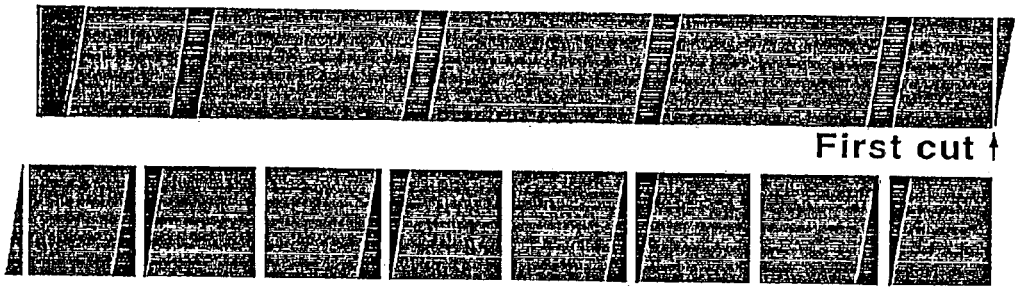
fig. 15
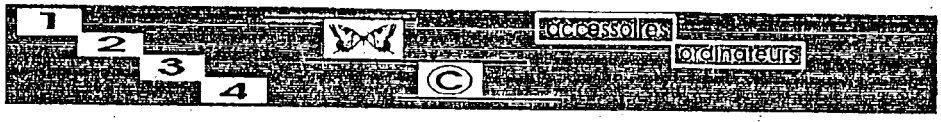
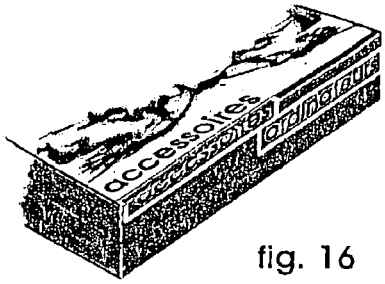
fig. 16
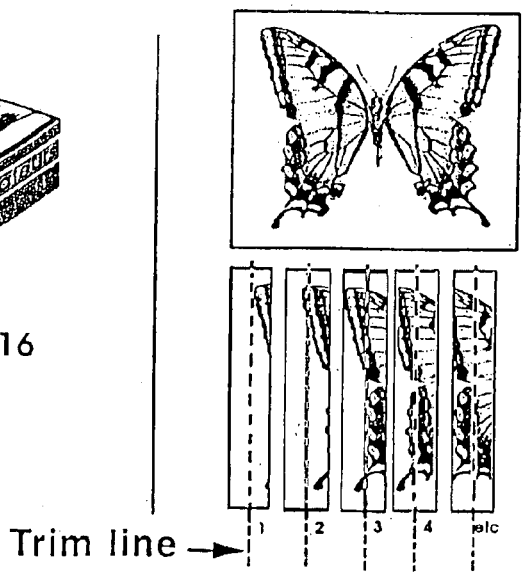
fig,17

METHOD FOR PRODUCING IMAGES IN THE EDGE OF A VOLUME OF PAPER SHEETS

This application is a Section 371 national phase of PCT/FR01/00141.

BACKGROUND OF THE INVENTION

The present invention relates to a process for making images on the side of a volume of paper sheets.

SUMMARY OF THE INVENTION

The invention provides a process for the fabrication of a block of paper sheets carrying images on the side. The process comprises the steps of:

(a) printing portions of the image on at least one major surface of the paper sheets in the block;

(b) skewing the block of paper sheets to offset the printed portions of the image with respect to one another; and (c) trimming the skewed block of paper sheets in a plane perpendicular to the paper sheets, said plane passing through the images. As a result, the image emerges in the plane of cutting, reconstituted from successive strips, and further evidenced by the skewing of the block of paper, before assembly or by torsion of block after assemblage or binding.

BRIEF DESCRIPTION OF THE DRAWINGS

FIG. 14 shows the formation of two images using a single block with the images initially printed in the middle.

FIG. 15 shows multiple groups of images as in FIG. 14.

FIG. 16 shows the edge of a cut block of paper sheets.

FIG. 17 shows the division of an image into sections relative to the cutting line.

DETAILED DESCRIPTION OF THE INVENTION

The characteristic lies in the capacity of recombining images in the section of a block of paper and combinative potential (texts or images) in anamorphisms, deformations and forms.

The invention can be applied to a series of paper products: note books, note pads, books etc. . . . or to facilitate innovation of new objects and games. The contribution can also be decorative, advertising, promotional or indicative. In the past, there were impressions of texts or images on the side of books or the section of blocks of paper. In the present invention, the images are printed not on the side but on the surface of paper so as to keep coherence of the image and sufficient quantity of the image elements. The process comprises a series of steps:

1) Impression of the volume of paper recto sheets or verso (black and white, monochromy or quadrichromy), with the selected side (P1.1 fig.a).

Figure 2:
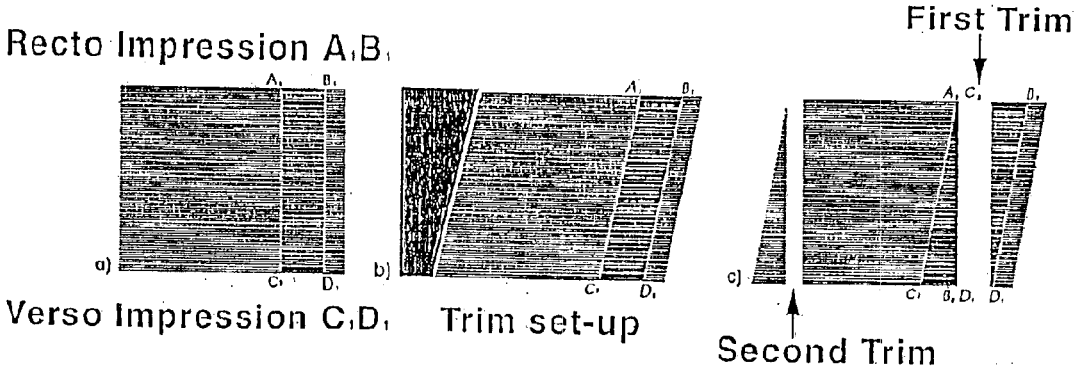
FIG. 2 shows the three basic steps of the method of the invention.

2) Skewing the volume of paper to an angle different than 90', with the help of a device so that the two ends of the image are found on a common perpendicular line to the plane of the paper (P1.1 FIG. 2*b*).

3) Trimming the block of paper through the printed image (P1.1 FIG. 2*c*).

Figure 3:
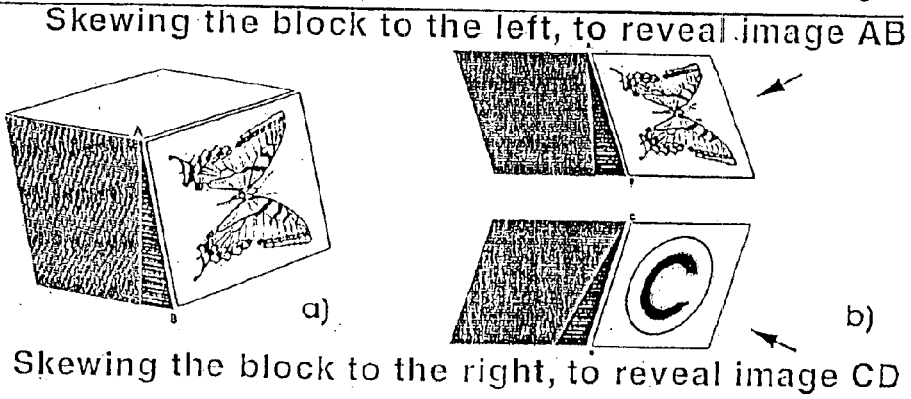
FIG. 3 shows the skewing of a block of paper resulting on the display of an image.

One result, the recombining of the images in the height of the volume of paper sheets which appear in the section, at least, in a theoretical way, the image will not be really and clearly visible until a shift of the sheets the ones compared to the others, or by the distorsion of the volume of the paper sheets (P1.1 fig.a). In the case of the verso impression, one or the other image appears according to the direction of the distorsion in an alternative way (P1.1 FIG. 3*b*).

Figure 1:
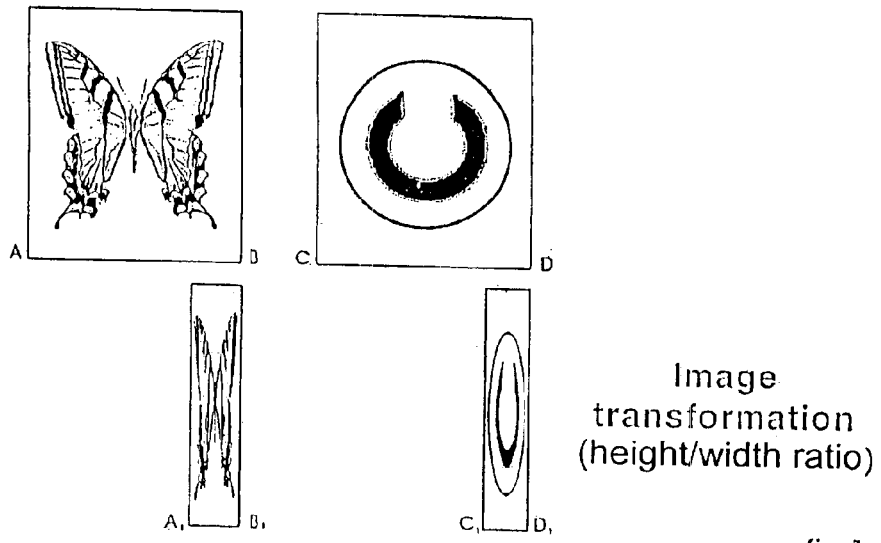
FIG. 1 shows compression of an optical image which may be done prior to printing.

In the present invention, it is significant sometimes to carry out the compression of the images to be printed (P1.1 FIG. 1) in order to not block the finality of the object: books, magazines, diaries, note books, note pads, play cards, etc. . . . In the end, the image refinds its original dimension on the side of the paper block.

Figure 4:
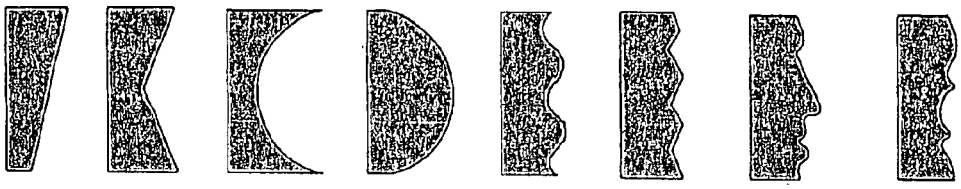
FIG. 4 shows various alternative shapes which can be used for skewing a block of paper prior to trimming.
Figure 5:
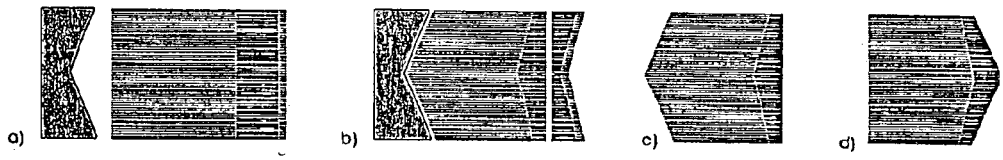
FIG. 5 shows skewing of a block of paper sheets against a shaped form prior to trimming.
Figure 6:
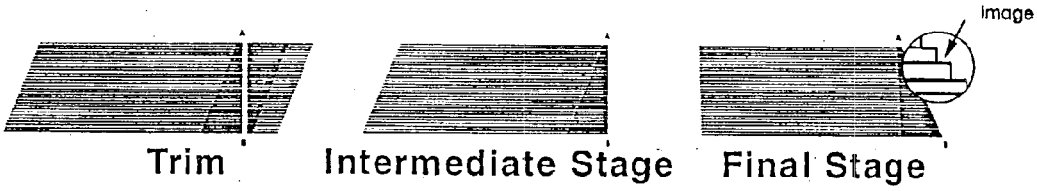
FIG. 6 shows the formation of a block of paper in which the printed edges are left exposed after trimming.
Figure 7:
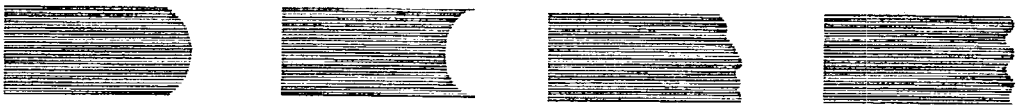
FIG. 7 shows blocks of paper with different shapes formed along the printed edge.

The images can undergo various deformations for different graphic purposes. The combination image-texts, initials or symbols can be carried out in a promotional goal, advertising, decorative, a pun or images such as for example, the recto impression of a winter landscape and on the verso the same landscape in summer. The introduction of a third image by impression on the section is possible. The process of alignment before the trimming can be done in various geometrical or figurative forms (P1.2 FIG. 4). The shift of the sheets can be carried out without form by other procedures and one can consider distorsions in the mass of paper or a repositioning of the sheets, one compared to another (example by rotation.) The purpose of the device in special forms is a specific deformation of the image and the will to mix it with a relief which lets the image be seen in a certain manner. After trimming, for a possible binding, it is necessary to readjust the sheets in right angle (P1.2 FIG. 7). In certain cases, a retrimming is necessary to recreate the parallelism of the volume of paper sheets (P1.1 FIG. 2*c*). In another case, one can connect without retrimming, while readjusting to 90' (P1.2 FIG. 6). This type of binding leaves visible the recto image, without torsion (P1.2 FIG. 6). Several combinations can leave visible entirely or partially the images in home position. One can forsee, in cases of productivity, the design of a press which modifies the position of the impression, breaks into leaf by sheet to thus carry out the skewing phase before trimming.

Figure 8:
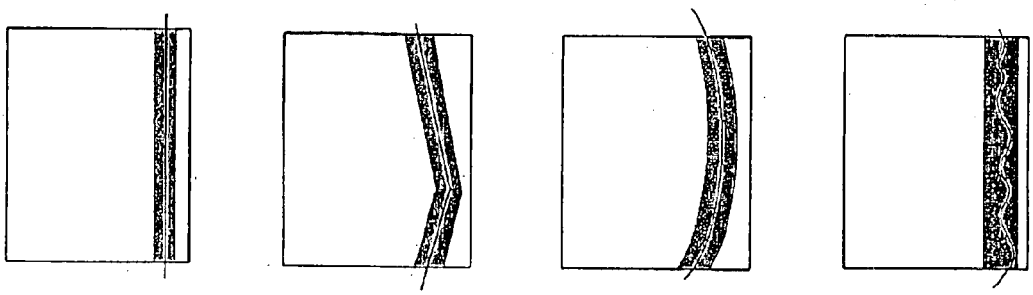
FIG. 8 shows alternative cutting shapes when viewed from the top of a block of paper.
Figure 9:
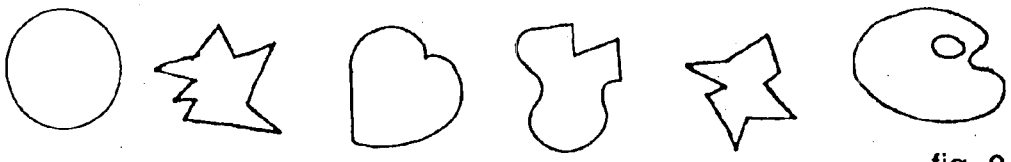
FIG. 9 shows exemplary cut shapes of the block of paper when viewed from the top.
Figure 10:
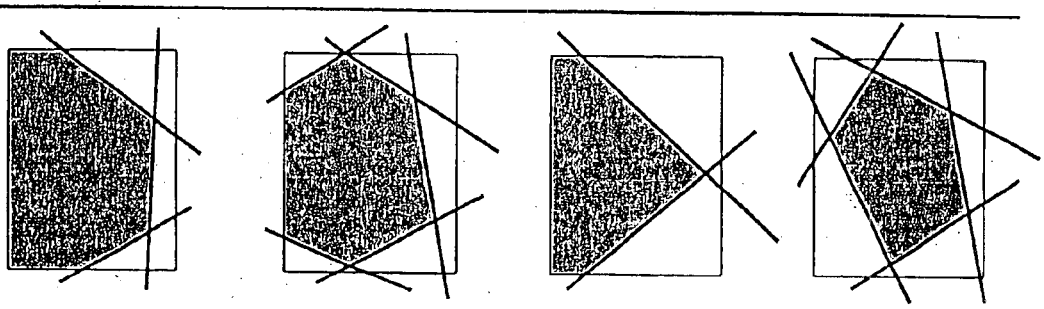
FIG. 10 shows the use of multiple trimming steps.

Trimming according to the design or for particular concepts, can be carried out with a straight, curved or angular blade, etc. . . . (P1.2 FIG. 8) or with all other form of cutting (P1.3 FIG. 9). The trimming can also be composed of several interventions or the combined interventions (P1.3 FIG. 10). The impression of the paper sheets, in this case, can comprise one or more images adapted to the interventions of cutting. In certain cases, the impressions and the trimming can be carried out on one, two or several sides and the operations impression-trimming followed by a second impression and of a retrimming on different places.

Figure 11:
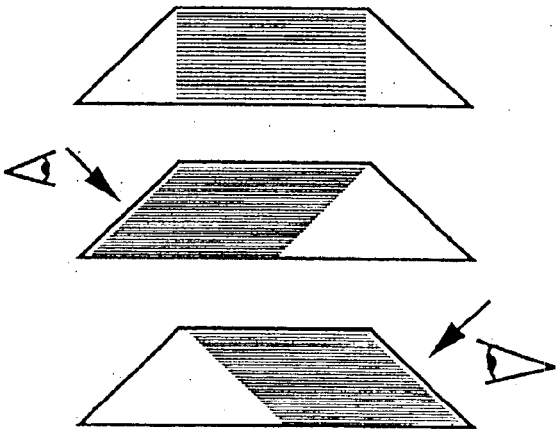
FIG. 11 shows the use of a box to allow a block of paper to reconfigure itself by sliding within the box to display alternative images.
Figure 12:
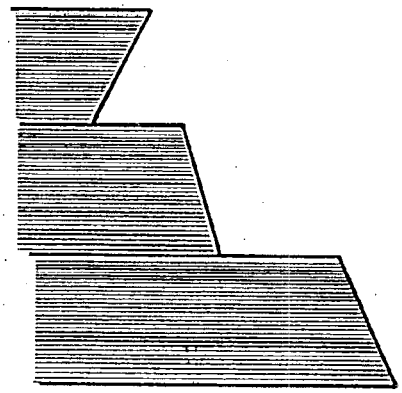
FIG. 12 shows an assemblage of several blocks of paper sheets.
Figure 13:
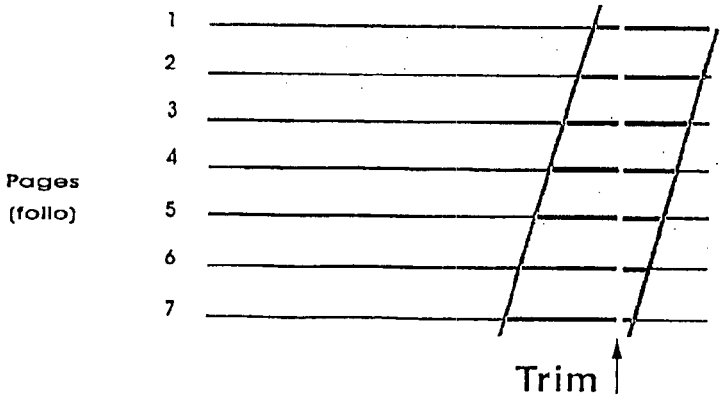
FIG. 13 shows the offset of an image relative to a cutting reference line.

The objects can also be composed of several thicknesses of paper (P1.3 FIG. 12). The paper sheets can be free, glued or connected in all manners (before or after the trimming). The printed and trimmed blocks of paper can also be locked up in transparent boxes of different shapes, letting the images appear. The rigid or flexible boxes can leave by their design, paper to reposition itself in several ways (P1.3 FIG. 11). The imprint can be recto simple or to have the same image printed on the back, mirroring with the same co-ordinates. For aesthetic or practical reasons, the thickness of the blocks can be different and paper can have different weights. The sheets can be of different nature (ex: opaque plastic or transparency). Two objects can be carried out in the same block of paper and to profit from the same mirroring images (P1.4 FIG. 14). In the manufacturing process, one can obtain several objects from the same block of paper. Only one aligning device with a different than 90° angle, transmits the shift to the assembly. Then, the objects are separated by normal trimming at 90° (P1.4 FIG. 16). The printing of images on the trimming side, can be a remake on an already printed and stitched volume of paper, to improve its quality. For the extension of this invention on technological processes where the printing, stitching and the trimming are done at the same time, one simulates the process of skewing in the preparation with the printing. An image compressed or not, can be introduced into the formatting of a volume, be skewed systematically compared to the reference marks of cutting (P1.3 FIG. 13) and thus to envisage and break up the process of the invention for an equivalent result without movement of retiming before trimming (significant for the manufacture of books, magazine, catalogues etc . . . ). The skewing will be made compared to the margin of cutting (principle of the lost bottom) in connection with the folio and the number of pages. One can have the same result to leave the image uncompressed, divided systematically in sections added in the formatting as in the preceding case (P1.4 FIG. 17).

In the present invention, one can envisage software which would allow the preparation of the image and the automatic introduction into a folio. The invention can be applied to catalogues of sale, telephone directories, dictionaries, diaries etc . . . , for information purposes, on the contents and its position in volume. The information can be graphic, image or text etc. . . . In the case of text, the intervention can be complementary to the current method which is that of printing a text-advertiser on each page of a chapter (P1.4 FIG. 16). With the risk of worse quality, one can simulate the assembly process by printing or a shifted cutting, sheet by sheet. A solvent can be applied to improve the visibility of the image on the trimmed side. If, on the other hand, the image must be hidden, the side of the trimmed block of paper can be gilded.

What is claimed is:

1. A process for the fabrication, from a single block of paper made of a volume of stacked paper sheets, of a plurality of paper products each in the form of a sub-block with an image produced on a side of the sub-block, said method comprising the steps of:

(a) printing a plurality of images on at least one major surface of the paper sheets in the block;

(b) skewing the block of paper sheets in a direction to offset the printed images with respect to one another; and (c) trimming the skewed block of paper sheets in a plurality of planes perpendicular to the major surfaces of the paper sheets, at least one of said plane passing through at least one image such that the plane passes through a leading edge of the image at the top of the paper block, and through an opposed trailing edge of the image at the bottom of the paper block, thereby forming a plurality of paper products in the form of sub-blocks cut from the block.

2. The process of claim 1, wherein the image is compressed in one dimension prior to printing.

3. The process of claim 1, further comprising the step of retrimming those paper product sub-blocks cut from an edge of the skewed block, thereby recreating sub-blocks with parallel surfaces.

4. The process of claim 1, wherein the trimming is performed in several planes simultaneously.

5. The process of claim 1, wherein the trimming is performed in several different steps one after another.

6. The process of claim 1, wherein at least half of the trimmings do not intersect with images.

7. The process of claim 1, further comprising the step of applying a coating of paint or gilding to the trimmed sub-block of paper sheets in order to hide the images which will only be visible by skewing the block of paper sheets.

8. The process of claim 1, further comprising the step of rotating the paper sheets in the block, one compared to another, before trimming to generate deformations or anamorphisms in the image.

9. The process of claim 1, further comprising the step of rotating the paper sheets in a sub-block, one compared to another, after trimming to generate deformations or anamorphisms in the image.

10. The process of claim 1, wherein the trimming is performed with a blade or a shaped knife.

11. The process of claim 1, further comprising the step of realigning of a printed sub-block of paper sheets after trimming against an arbitrary form.

12. The process of claim 1, wherein the images are printed on both top and bottom major surfaces of the sheets of paper in the block, whereby two images are formed along a trimming plane passing through the images.

13. The process of claim 12, wherein the image compressed in one dimension prior to printing.

14. The process of claim 12, further comprising the step of retrimming those paper product sub-blocks cut from an edge of the skewed block, thereby recreating sub-blocks with parallel surfaces.

15. The process of claim 12, wherein the trimming is performed in several planes simultaneously.

16. The process of claim 12, wherein the trimming is performed in several different steps one after another.

17. The process of claim 12, wherein at least half of the trimmings do not intersect with images.

18. The process of claim 12, further comprising the step of applying a coating of paint or gilding to the trimmed sub-block of paper sheets in order to hide the images which will only be visible by skewing the block of paper sheets.

19. The process of claim 12, further comprising the step of rotating the paper sheets in the block, one compared to another, before trimming to gen rate deformations or anamorphisms in the image.

20. The process of claim 12, further comprising the step of rotating the paper sheets in a sub-block, one compared to another, after trimming to gen rate deformations or anamorphisms in the image.

21. The process of claim 12, wherein the trimming is performed with a blade or a shaped knife.

22. The process of claim 12, further comprising the step of realigning of a printed sub-block of paper sheets after trimming against an arbitrary form.

* * * * *